US009049506B2

(12) United States Patent
Jiang et al.

(10) Patent No.: US 9,049,506 B2
(45) Date of Patent: Jun. 2, 2015

(54) MICRO-SPEAKER

(71) Applicants: Wen-Tao Jiang, Shenzhen (CN); Lei Shi, Shenzhen (CN); Xiong Zhang, Shenzhen (CN); San-You Wu, Shenzhen (CN); Lin-Zhen Li, Shenzhen (CN)

(72) Inventors: Wen-Tao Jiang, Shenzhen (CN); Lei Shi, Shenzhen (CN); Xiong Zhang, Shenzhen (CN); San-You Wu, Shenzhen (CN); Lin-Zhen Li, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 13/921,299

(22) Filed: Jun. 19, 2013

(65) Prior Publication Data

US 2013/0279737 A1 Oct. 24, 2013

Related U.S. Application Data

(63) Continuation-in-part of application No. 13/190,563, filed on Jul. 26, 2011, now abandoned.

(51) Int. Cl.

| | |
|---|---|
| ***H04R 1/00*** | (2006.01) |
| ***H04R 9/02*** | (2006.01) |
| *H04R 9/06* | (2006.01) |
| *H04R 9/10* | (2006.01) |

(52) U.S. Cl.
CPC *H04R 9/025* (2013.01); *H04R 9/06* (2013.01); *H04R 9/10* (2013.01); *H04R 2499/11* (2013.01)

(58) Field of Classification Search
CPC ..... H04R 9/025; H04R 9/06; H04R 2499/11; H04R 2499/13; H04R 2499/15; H04R 9/10; H04M 1/03; H04M 1/6041
USPC ..... 381/190, 191, 400, 419, 420, 421, 412, 381/396, 433, 414, 422, 424, 401; 455/550.1, 575.1
See application file for complete search history.

(56) References Cited

U.S. PATENT DOCUMENTS

| | | | | |
|---|---|---|---|---|
| 7,065,225 | B2 * | 6/2006 | Stiles | 381/412 |
| 2005/0271226 | A1 * | 12/2005 | Tanabu et al. | 381/182 |
| 2011/0255732 | A1 * | 10/2011 | Kwon et al. | 381/396 |
| 2012/0008816 | A1 * | 1/2012 | Liu et al. | 381/401 |

* cited by examiner

*Primary Examiner* — Curtis Kuntz
*Assistant Examiner* — Sunita Joshi
(74) *Attorney, Agent, or Firm* — Anova Law Group, PLLC

(57) ABSTRACT

A micro-speaker includes a yoke, a magnet assembly attached to the yoke, a voice coil, and a diaphragm connected with the voice coil. The yoke defines a bottom wall, and a number of sidewalls extending upwards from the bottom wall. The magnet assembly includes a main magnet positioned on the bottom wall, and a number of secondary magnets positioned on tops of the sidewalls.

12 Claims, 4 Drawing Sheets

MICRO-SPEAKER

This application is a continuation-in-part of application Ser. No. 13/190,563, filed on Jul. 26, 2011.

FIELD OF THE INVENTION

The present invention relates to the art of speakers, particularly to a micro-speaker used in an electronic device.

DESCRIPTION OF RELATED ART

Micro-speakers have been widely used in portable electronic devices, such as cellular phones, notebooks, and so on. With the continuing development of the portable electronic devices, people request for more and more functions with audible sensations, which brings a rapid development of the technologies of micro-speakers.

A related micro-speaker includes a bowl-shaped base, an upper cover attached to the base for forming a receiving space therebetween, a permanent magnet and a plate disposed within the base and forming a magnetic gap corporately with the base in the receiving space, a diaphragm adjoining with the upper cover, a voice coil attached to the diaphragm and suspended in the magnetic gap, and a circuit board disposed outside of the base for electrically connecting to an exterior circuit board. Leads of the voice coil pass through corresponding holes provided by the base to connect to the circuit board. When an oscillating electric current is supplied to the voice coil from the circuit board, a corresponding alternant force on the voice coil is generated by a magnetic field produced in the magnetic gap. This compels the voice coil to vibrate, and the oscillating voice coil drives the diaphragm to push ambient air to generate sound. However, the sensitivity of the micro-speaker with the structures mentioned above is too low to satisfy the desired requirements.

Therefore, it is desirable to provide a micro-speaker which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENT

Figure 1:
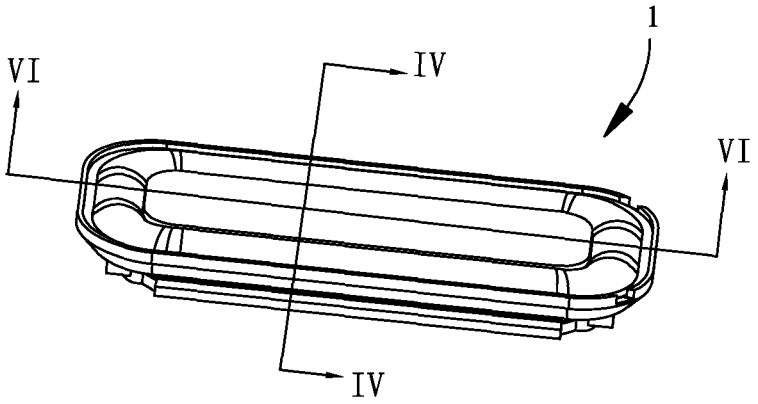
FIG. 1 is an isometric view of a micro-speaker according to an exemplary embodiment of the present invention.
Figure 2:
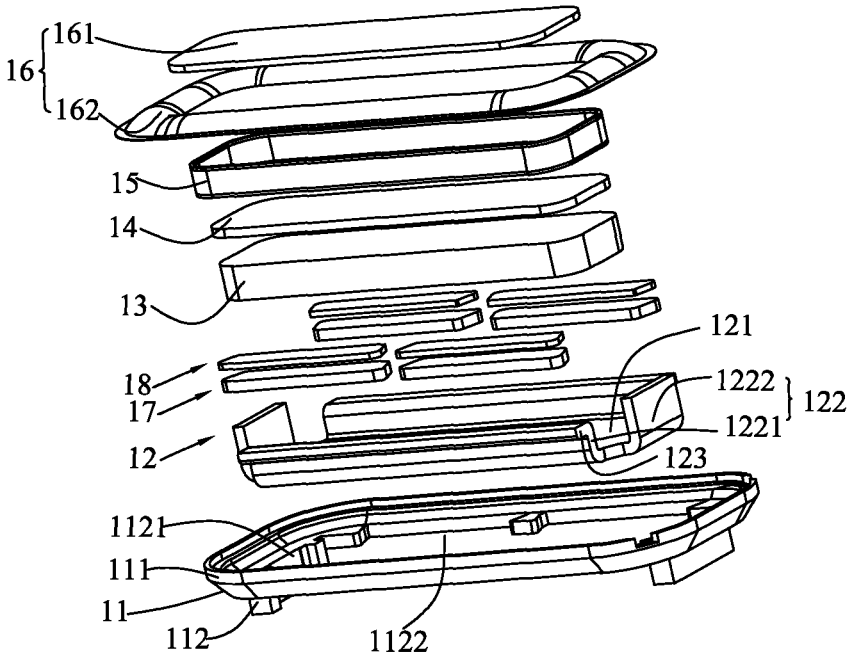
FIG. 2 is an exploded view of the micro-speaker of FIG. 1.
Figure 3:
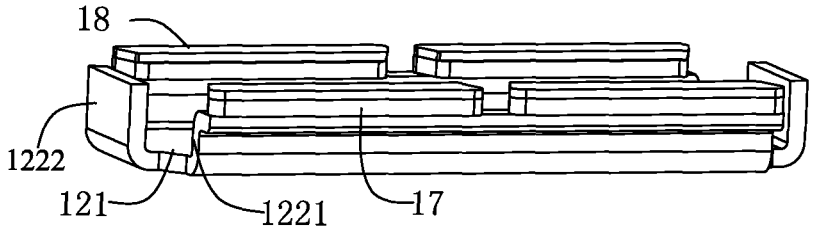
FIG. 3 is an assembled view of a combination of a yoke, secondary magnets and plates of the micro-speaker.
Figure 4:
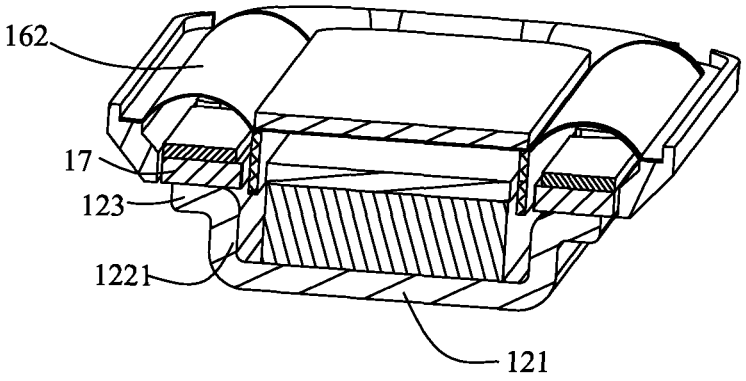
FIG. 4 is a cross-sectional view of the micro-speaker taken along line IV-IV of FIG. 1.
Figure 5:
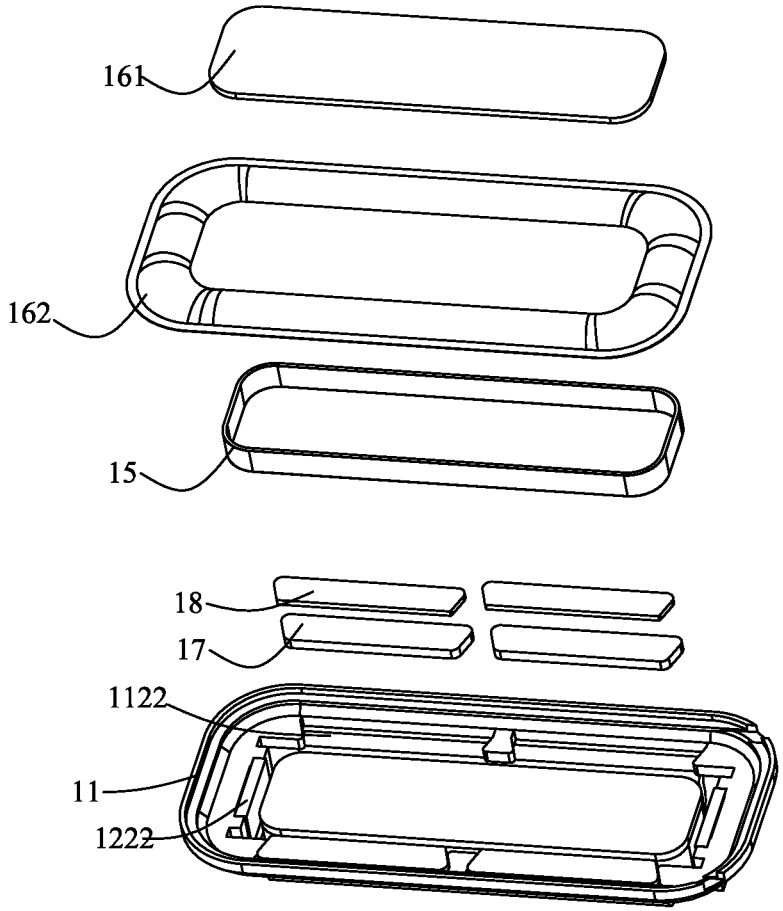
FIG. 5 is a partially assembled view of the micro-speaker, with a diaphragm, a voice coil and two secondary magnets separated from the micro-speaker.
Figure 6:
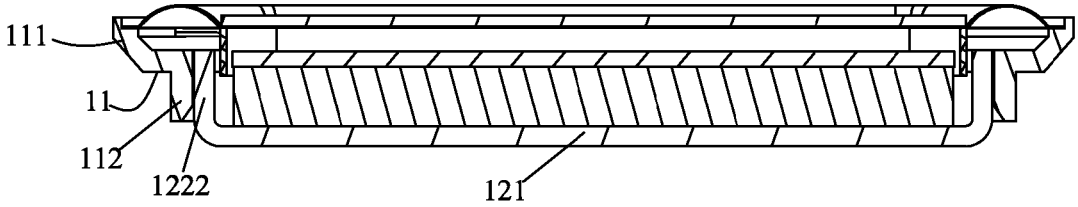
FIG. 6 is a cross-sectional view of the micro-speaker taken along line VI-VI of FIG. 1.

Referring to FIGS. 1-2, a micro-speaker 1 according to an exemplary embodiment, includes a frame 11, a magnetic circuit unit including a yoke 12 engaged with the frame 11, a main magnet 13 and forming a first magnetic gap with a plurality of sidewalls 122 of the yoke 12, a vibrating unit including a voice coil 15 partially accommodating in the first magnetic gap and a diaphragm 16 connected with the voice coil 15. The diaphragm 16 includes a top plate 161 and a periphery portion 162 surrounding the top plate 161. The periphery portion 162 has a curved surface.

When an oscillating electric current is supplied to the voice coil 15, a corresponding alternant force on the voice coil 15 is generated by a magnetic field produced in the first magnetic gap to compel the voice coil 15 to vibrate, and the voice coil 15 drives the diaphragm 16 to push ambient air to generate sound.

Referring cooperatively to FIG. 3-6, the yoke 12 further includes a bottom wall 121 forming a receiving space corporately with the sidewalls 122. The bottom wall 121 has a rectangular configuration and has two long sides and two short sides. The plurality of sidewalls 122 include a pair of first sidewalls 1221 extending perpendicularly from the long sides of the bottom wall 121 and a pair of second sidewalls 1222 extending perpendicularly from the short sides of the bottom wall 121. A fringe 123 extends outwards from a top face of the first sidewall 1221 along a direction away from the bottom wall 121. In this embodiment, two opposed fringes 123 are disposed at two long sides of the yoke 12. A distance between two distal ends of two opposed fringes 123 is greater than a width of the bottom wall 121. The first magnetic gap is forming between the sidewalls 122 and the main magnet 13.

The fringe 123 is provided with a plurality of secondary magnets 17 disposed thereon. A second magnetic gap is forming between the secondary magnets 17 and the main magnet 13, and communicating with the first magnetic gap. In this embodiment, each of the fringe 123 is provides with two independent secondary magnets 17. The voice coil 15 is partially inserting into the first magnetic gap via the second magnetic gap. The secondary magnets 17 are disposed below the periphery portion 162 and within a projection of the periphery portion 162 along a direction perpendicular to the bottom wall.

Apparently, when an oscillating electric current is supplied to the voice coil 15, the secondary magnets 17 also provide a corresponding magnetic field in the second magnetic gap to compel the voice coil 15 to vibrate. Therefore, the micro-speaker 1 is more sensitive by adding the secondary magnets 17.

The main magnet 13 is provided with a first plate 14 disposed thereon. Each of the secondary magnets 17 is provided with a second plate 18 thereon. The second plates 18 are capable of closing the magnetic fluxes produced by the secondary magnets 17 and generating more effective magnetic flux density for compelling the voice coil 15.

The frame 11 includes an upper portion 111 and a lower portion 112 together forming a receiving space for receiving the vibrating unit and the magnetic circuit unit. The diaphragm 16 is attached to the upper portion 111. The magnetic circuit unit is retained by the lower portion 112. The lower portion 112 includes a first slot 1121 disposed at an inner face of a short side of the lower portion 112. The second sidewall 1222 of the yoke 12 is received and positioned in the first slot 1121. The lower portion 112 further includes a plurality of second slots 1122 disposed at an inner face of a long side of the lower portion 112. The secondary magnets 17 are received in the second slots 1122. In other embodiment, the secondary magnets 17 are fixed on the fringes 123 and the frame 11 by glue or by soldering.

In summary, a micro-speaker in accordance with an exemplary embodiment of the present invention includes a yoke, a magnet assembly attached to the yoke, magnetic gaps formed between the magnet assembly and the yoke, a voice coil partially received in the magnetic gaps, and a diaphragm connected with the voice coil. The yoke defines a bottom wall, and a plurality of sidewalls extending upwardly from the bottom wall. The magnet assembly comprises a main magnet positioned on the bottom wall, and a plurality of secondary magnets positioned on tops of the sidewalls. The magnetic gaps include a first magnetic gap formed between an outer surface of the main magnet and inner surfaces of the sidewalls of the yoke, and a second magnetic gap formed between the main magnet and the secondary magnets. Further, the first magnetic gap is communicated with the second magnetic gap. The voice coil is partially received in the combination of the first and second magnetic gaps. For positioning the secondary magnets firmly, the sidewalls of the yoke define a plurality of fringes extending parallel to the bottom wall for carrying the secondary magnets.

It will be understood that the above-mentioned particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A micro-speaker comprising:

a yoke defining a bottom wall, a plurality of sidewalls extending upwards from the bottom wall, and a plurality of fringes extending outwards from top faces of the sidewalls along directions parallel to the bottom wall;

a magnet assembly attached to the yoke, including a main magnet positioned on the bottom wall and a plurality of secondary magnets positioned on tops of the fringes;

magnetic gaps formed between the magnet assembly and the yoke, including a first magnetic gap formed between an outer surface of the main magnet and an inner surface of the sidewalls of the yoke and a second magnetic gap formed between the main magnet and the secondary magnets, the first magnet gap being communicated with the second magnetic gap;

a voice coil partially received in a combination of the first and second magnetic gaps;

a diaphragm connected with the voice coil;

a frame including an upper portion and a lower portion together forming a receiving space for receiving the yoke and the magnet assembly; wherein the lower portion includes at least a slot disposed at an inner face thereof for receiving the secondary magnet.

2. The micro-speaker as claimed in claim 1, wherein each of the main magnet and secondary magnets is provided with a plate thereon.

3. The micro-speaker as claimed in claim 2, wherein the plurality of sidewalls includes a pair of first sidewalls extending perpendicularly from two long sides of the bottom wall and a pair of second sidewalls extending perpendicularly from two short sides of the bottom wall.

4. The micro-speaker as claimed in claim 3, wherein the plurality of fringes includes two opposed fringes extending from the two first sidewalls and disposed at the long sides of the yoke.

5. The micro-speaker as claimed in claim 4, wherein a distance between two distal ends of two opposed fringes is greater than a width of the bottom wall.

6. A micro-speaker comprising:

a frame, including an upper portion and a lower portion;

a magnetic circuit unit accommodated in the frame and retained by the lower portion, including a yoke with a receiving space, a main magnet disposed in the receiving space and forming a first magnetic gap corporately with the yoke, at least one secondary magnet attached to the yoke and disposed outside of the receiving space;

a vibrating unit engaged with the frame, including a diaphragm and a voice coil connected with the diaphragm;

a second magnetic gap formed between the main magnet and the at least one secondary magnet; wherein the voice coil is partially inserting into the first magnetic gap via the second magnetic gap;

the lower portion includes at least a slot disposed at an inner face thereof for receiving the secondary magnet.

7. The micro-speaker as claimed in claim 6, wherein the yoke includes a bottom wall, a pair of first sidewalls and a pair of second sidewalls extending upwards and perpendicularly from the bottom wall.

8. The micro-speaker as claimed in claim 7, wherein a fringe extends outwards from a top face of the first sidewall along a direction away from the main magnet and is paralleled to the bottom wall.

9. The micro-speaker as claimed in claim 8, wherein two independent secondary magnets are disposed at the first sidewall.

10. The micro-speaker as claimed in claim 9, wherein the lower portion further includes a slot for receiving and fixing the second sidewall.

11. A micro-speaker comprising:

a frame;

a magnetic circuit unit accommodated in the frame, including a yoke with a bottom wall carrying a part of the magnetic circuit unit, a plurality of sidewalls extending perpendicularly from the periphery of the bottom wall and including a pair of fringes parallel to the bottom wall, a main magnet disposed on the bottom wall and forming a first magnetic gap corporately with the plurality of sidewalls, and at least two secondary magnets attached to the fringes and locating at the top of the magnetic circuit unit;

a vibrating unit engaged with the frame, including a diaphragm and a voice coil connected with the diaphragm, the diaphragm including a top plate and a periphery portion surrounding the top plate;

a second magnetic gap formed between the main magnet and the at least two secondary magnets; wherein the voice coil partially inserts into the first magnetic gap via the second magnetic gap;

the secondary magnets are disposed within a projection of the periphery portion of the diaphragm along a direction perpendicular to the bottom wall.

12. The micro-speaker as claimed in claim 11, wherein each fringe is provided with two secondary magnets, and each secondary magnet is provided with a plate thereon.

* * * * *